US006773203B2

(12) United States Patent
Casters

(10) Patent No.: US 6,773,203 B2
(45) Date of Patent: Aug. 10, 2004

(54) PAVING MACHINE AND METHOD FOR FORMING A CONCRETE PATH

(75) Inventor: François Casters, Opglabbeek (BE)

(73) Assignee: Drion Constructie, besloten vennootschap met beperkte aansprakelijkheid, Opglabbeek (BE)

( * ) Notice: Subject to any disclaimer, the term of this patent is extended or adjusted under 35 U.S.C. 154(b) by 0 days.

(21) Appl. No.: 10/161,741

(22) Filed: Jun. 5, 2002

(65) Prior Publication Data

US 2002/0187004 A1 Dec. 12, 2002

(30) Foreign Application Priority Data

Jun. 5, 2001 (BE) ..... 20010380

(51) Int. Cl.[7] ..... E01C 19/22
(52) U.S. Cl. ..... 404/84.1; 404/101; 404/118
(58) Field of Search ..... 404/83, 84.05, 404/84.1, 84.2, 84.5, 84.8, 90, 92, 96, 100, 101, 72, 75, 118–120

(56) References Cited

U.S. PATENT DOCUMENTS

| | | | | | |
|---|---|---|---|---|---|
| 3,970,405 | A | * | 7/1976 | Swisher et al. | 404/15 |
| 4,124,325 | A | * | 11/1978 | Cutler | 404/75 |
| 4,345,852 | A | * | 8/1982 | Goto et al. | 404/114 |
| 4,655,633 | A | * | 4/1987 | Somero et al. | 404/75 |
| 4,682,908 | A | * | 7/1987 | Domenighetti | 404/84.1 |
| 5,288,166 | A | * | 2/1994 | Allen et al. | 404/84.1 |
| 5,588,776 | A | * | 12/1996 | Swisher et al. | 404/72 |
| 5,590,977 | A | * | 1/1997 | Guntert et al. | 404/101 |
| 5,615,972 | A | * | 4/1997 | Guntert et al. | 404/72 |
| 5,941,659 | A | | 8/1999 | Godbersen | |
| 6,129,481 | A | * | 10/2000 | Tapio et al. | 404/102 |
| 6,152,647 | A | * | 11/2000 | Tapio et al. | 404/75 |
| 6,183,160 | B1 | * | 2/2001 | Tapio et al. | 404/84.1 |
| 6,390,728 | B1 | * | 5/2002 | Casters | 404/100 |
| 6,481,923 | B1 | * | 11/2002 | Casters | 404/104 |

FOREIGN PATENT DOCUMENTS

| | | | | |
|---|---|---|---|---|
| DE | 198 14 052 A1 | | 10/1999 | |
| EP | 893539 A1 | * | 1/1999 | E01C/19/40 |
| EP | 1264934 A2 | * | 12/2002 | E01C/19/40 |
| WO | WO 95/28525 | | 10/1995 | |

* cited by examiner

*Primary Examiner*—Thomas B. Will
*Assistant Examiner*—Alexandra K. Pechhold
(74) *Attorney, Agent, or Firm*—Bacon & Thomas, PLLC

(57) ABSTRACT

A paving machine arranged to spread and level concrete along a path. The paving machine has a frame assembly, and at least one concrete processing device carried by the frame assembly. The processing device include at least two mutually screed elements spanning the width of the frame assembly and are mutually adjustable in height relative to the frame assembly. The paving machine futher include a control device that positions the at least two screed elements relative to the frame assembly.

14 Claims, 4 Drawing Sheets

IV
IV
F2

PAVING MACHINE AND METHOD FOR FORMING A CONCRETE PATH

BACKGROUND OF THE INVENTION

This invention relates to a paving machine, more particularly a machine for spreading and levelling concrete, as well as to a method for forming a concrete path.

As known, such paving machines are used for forming a variety of concrete pavings, in the first place for forming concrete roadways, but, furthermore, also for forming large concrete floors and such.

It is known that such paving machines mostly consist of a movable frame at which one or more processing devices for processing the concrete are fixed or can be fixed. Mostly, use is made of several processing devices providing for different processings, such as spreading the concrete, which has been poured in front of the device, in width, vibrating the concrete, drawing the concrete into a shape, providing dowels in the concrete, smoothing the concrete by means of a smoothing beam and finishing by means of a smoothing board moving to and fro.

It is also known that such paving machines, including the processing devices, can be made extensible in order to be able to adjust the working width. An example thereof is known from the international patent application WO 95/28525. In such case, the frame as well as the processing devices are telescopically extensible, whereby the processing devices then consist of several parts which telescope either in each other or along each other or at a distance behind each other.

Such paving machines, the processing devices of which consist of several parts which together must span the working width, and especially paving machines with parts which, as aforementioned, are extensible in respect to each other, show the disadvantage that the mutual position of the parts of one and the same processing device may change during paving, as a result of sagging under the weight of the paving machine and/or as a result of the pushing in upward direction, when, centrally below the paving machine, a surplus of concrete is poured. This has as a consequence that the surface of the formed concrete path deviates from the desired shape. It has already been proposed to remedy this by using manually turnable screw jacks with which the mutual position of the aforementioned parts can be adjusted. This solution, however, has the disadvantage that it is less efficient, as in practice an adjustment exclusively will be carried out when major, visually discernible deviations occur.

Further, it is also known that paving machines can be equipped with oscillating finishing beams for assisting in smoothing the concrete of the path surface. An example thereof is described in U.S. Pat. No. 5,941,659, in which two finishing beams, situated at a distance from each other according to the direction of movement, are applied, i.e. one finishing beam performing a substantially vertical oscillation, and a finishing beam performing a substantially horizontal oscillation. The vertical oscillation has as a purpose, so to speak, to tamper the gravel in the concrete into the surface, whereas the horizontal oscillation additionally smoothes the concrete at the surface. In that hereby use is made of two oscillating finishing beams cooperating with one and the same path surface, such embodiment, however, shows the disadvantage that the average positions which are taken by these finishing beams in respect to the formed path surface, have to be precisely coordinated in mutual respect, and that, with certain deviations, malfunctions in the faultless working may occur. Another disadvantage consists in that two separately driven systems, one behind the other, are necessary, as a result of which the total length of the paving machine, seen according to the paving direction, is influenced in a disadvantageous manner.

The present invention aims at a paving machine, whereby various improvements are intended which contribute to a better quality of the obtained concrete path and/or which allow for performing a more efficient control of the quality of the realized concrete path.

SUMMARY OF THE INVENTION

According to a first aspect of the invention, a paving machine is aimed at, with one or more processing devices consisting of two or more parts which together span the working width, whereby a solution is offered for efficiently excluding or minimizing deviations in the surface of the concrete path which arise as a consequence of undesired alterations in the mutual position of such parts. More particularly, according to this first aspect, it is aimed at excluding or at least minimizing undesired deviations as a result of the sagging of the paving machine and/or the pushing-up of parts thereof.

According to this first aspect, the invention thus relates to a paving machine, comprising a movable frame with at least one processing device for processing the concrete which extends according to the working width and which consists of at least two parts,or otherwise called screed elements, which possibly are movable in respect to each other, in order to adjust the span of the processing device, with as a characteristic that the paving machine comprises means, or otherwise called a control device, on one hand, directly or indirectly, control the mutual position of said parts, such in respect to the surface to be formed, as well as, on the other hand, allow for adjusting the mutual position in function of said control.

By providing the paving machine with means which, on one hand, allow for such control and, on the other hand, allow for an adjustment, a very precise follow-up of the mutual position of said parts is possible, and it is possible to rapidly take measures in order to remedy any undesired alteration in the position by means of a corresponding adjustment.

Preferably, said means consist of detection means or otherwise called a detection device, performing observations in respect to said mutual position, as well as controllable adjustment means, or otherwise called an adjustable device, for commanding said parts in such a manner that a desired adjustment is realized. More particularly, it is preferred that the controllable adjustment means are coupled to the detection means, such that an adjustment is performed in function of a desired adjustment of the mutual position. Thereby, an automatic feedback is provided for, whereby the operator of the paving machine himself no longer has to perform any adjustments.

Although the invention allows to counteract a variety of deviations between the positions of the respective parts of a processing device, it is clear that said means, in the first place, are intended to control the sagging, pushing-up, respectively, of the processing device.

In a practical form of embodiment, the frame of the paving machine, as usual, comprises two side parts carried by movable support elements, and according to the present invention, said means are configured such that they provide for a control in respect to a reference line, reference plane, respectively, which connects the two side parts. In practice, paving machines in fact are kept at a well-defined height at these side parts, for example, by means of sensors which command the height of the side parts in function of pre-set level lines. In the proximity of the side parts, the obtained concrete path thus always is at the right height, and lines or planes connecting the two side parts therefore ideally may serve as a reference line or plane for performing said control.

In the case that use is made of such reference line or such reference plane, said parts, at their outwardly directed extremities, are connected to the side parts preferably at a well-defined height, whereas with their inwardly directed extremities, they can be adjusted in height by means of said controllable adjustment means. When the paving machine is realized in a classical manner, with a central basic frame and with side parts provided on frame parts which are extensible in respect to the basic frame, it is preferred that the controllable adjustment means are situated between the basic frame and said two parts of the processing device. As a result thereof, said parts can be easily drawn upward, pushed downward, respectively, in the middle of the span.

According to an important preferred form of embodiment, said means comprise detection means which are formed by, on one hand, at least one cable stretched over the width of the paving machine and, on the other hand, one or more sensors cooperating with said cable and said parts of the processing device, which deliver signals in function of the difference in height between said cable and said parts. By a cable, hereby any form of stretchable flexible element has to be understood, thus, also a rope, ribbon or such. Such cable has the advantage that it forms a stable reference line which can hardly be disturbed, on the basis of which line said detection can be performed.

In the case that the paving machine comprises one or more processing devices with two or more parts which are movable in respect to each other, in order to adjust the span of the processing device, processing devices, respectively, said means preferably will comprise separately controllable adjustment means per processing device and/or per part of such processing device. In this manner, the position of each processing device, and still more particularly each part thereof, can be adjusted separately, as a result of which any form of deviation can be excluded.

However, this does not exclude that according to a variant, a common detection, for example, in a central point, can be provided for, and possibly also an adjustment by means of adjustment means which are common for several processing devices and/or parts thereof.

In the case that several separately controllable adjustment means for different processing devices or parts thereof are used, the paving machine preferably comprises several cable lengths stretched over the width of the paving machine, substantially at the height of the respective parts to be controlled of the processing device, processing devices, respectively, which cooperate with respective sensors. In this manner, at different locations an efficient control can be provided.

Hereby, it is particularly useful that the respective cable lengths then form part of a single continuous cable which is stretched several times over the width of the paving machine, with the advantage that only one set of means for tensioning the cable is necessary, which means, for example, consist of at least one winding system for winding the cable at least at one end, and/or of at least one elastic tensioning means, or otherwise called an elastic tensioning device, such as a tension spring.

The aforementioned device proves its usefulness especially in combination with the form elements and smoothing beams usually applied with paving machines. These, in fact, are heavyweight items, the respective parts of which easily become displaced in respect to each other, especially if they are telescopic.

Said controllable adjustment means may be of different kind, however, for practical reasons, it is preferred that pressure cylinders are applied to this end. It is clear that said means can be provided at new paving machines as well as at already existing paving machines, or that new paving machines can be equipped with elements which allow the attachment of such means. Of course, the invention thus relates to all these cases. Taking this into account, the invention thus also relates to a paving machine comprising a movable frame with at least one processing device for processing the concrete, which latter device extends according to the working width and which consists of at least two parts which are movable in mutual respect in order to adjust the span of the processing device, with the characteristic that the paving machine comprises controllable adjustment means with which the mutual position of said parts, such in respect to the surface to be formed, can be adjusted.

According to a second aspect of the invention, which either may or may not be combined with the first aspect, an improved embodiment of a paving machine is intended which is provided with one and more oscillating finishing beams, whereby said disadvantages of the known embodiments are excluded or at least are minimized.

To this aim, the invention, according to this second aspect, relates to a paving machine for forming a concrete path, whereby this paving machine comprises at least one oscillating finishing beam, with the characteristic that it comprises drive means which allow the finishing beam to perform an upward and a sideward oscillation at the same time. It is clear that thereby at least several of said disadvantages of using two separate finishing beams, oscillating upward and sideward, respectively, are excluded.

It also became clear that by the combination of an upward oscillation and sideward oscillation at one and the same finishing beam, anyhow a better smoothing effect is obtained.

Preferably, the drive means for the oscillating finishing beam consist of at least two excenter mechanisms providing for the respective oscillations.

In the most preferred form of embodiment, the paving machine, according to its direction of movement during paving, will comprise exclusively one oscillating finishing beam, with the exception of possible overlapping portions when several finishing beams, whether telescopically adjustable or not, are active over the working width.

Preferably, the finishing beam is mounted at a smoothing beam, more particularly attached in front of such smoothing beam.

According to a particular form of embodiment, the finishing beam forms part of a paving machine which is adjustable, more particularly extensible, in the direction of the working width, and does this beam consist of several mutually displaceable parts, whether situated at a distance from each other or not, and us each part equipped with its own driving means for delivering the upward and sideward oscillations.

According to a third aspect of the invention, a paving machine is aimed at whereby at all times an efficient control of the concrete of the formed concrete path and/or of the shape of the concrete path can be performed. Up to the present, basically a control only can be performed by afterwards measuring the realized concrete path and/or taking samples by means of drilling. Such samples can only be taken after a sufficient hardening of the concrete in order to perform measurements thereon, as a result of which one mostly has to wait approximately two months before such samples can be taken and tested. According to the third aspect of the invention, an efficient control can be realized in a completely different manner.

Thus, according to the aforementioned third aspect, the invention relates to a paving machine for forming a concrete path, with as a characteristic that it is provided with registration means which at least register data relating to the formed concrete path. By means of these registration means, thus, controllable parameters are obtained, from which the quality and other characteristics of the formed concrete path can be derived.

Preferably, it comprises registration means registering at least one or more of the following parameters:

- the width adjustment of the paving machine, more particularly of the working width;
- the forward speed of the paving machine or of a value representative therefor;
- the covered distance;
- the oscillation speed of vibrating means, such as vibrating needles, for vibrating the concrete;
- the thickness of the concrete path, possibly derived from other parameters;
- when a concrete path is poured having a roof-shaped profile, the inclination of the roof-shaped profile;
- the consumed quantity of concrete.

In the most preferred form of embodiment, at least two parameters are registered, on one hand, a parameter directly or indirectly related to the speed of the paving machine during paving, and, on the other hand, a parameter directly or indirectly related to the drive of the vibrating means for vibrating the concrete. The connection between these two parameters in fact forms a strong indication for the quality of the concrete. Possibly, this connection also may be formulated in a value, which value then has to be within well-defined limits. It is well-known that, in order to still enable a further paving of the path when the concrete is too wet or too dry, one may locally vibrate the concrete to a major or minor degree, as a result of which it is actually possible to continue working, but this mostly results in a diminishing quality of the concrete. By now following, by means of the registration means, the ratio between the parameters of vibrating and the parameters of the speed of forward movement, it will be automatically known whether the concrete will fulfill the quality requirements or not.

By means of said registration means, it is also possible to know where the most critical concrete parts are situated, where then possibly additional controls, by means of taking concrete samples, can be performed.

By means of the registration means, it can also be followed up whether a sufficient quantity of concrete per length unit has been applied and/or whether the realized concrete path thus also has a sufficient thickness.

The registered data can be registered in different manners, preferably in function of time and/or in function of the covered distance. For instance, the registration may take place by representing the data on a strip of paper, whether in the shape of curves or not, and/or by electronically storing these data, after which they can be visualized on a monitor and/or can be printed.

According to another variant, these data automatically will be transmitted to a central unit or a control authority, possibly still during the operation of the concrete paving machine, for example, by means of a wireless connection, for example, a telephone connection, more particularly by means of a cellular phone system or such.

According to a fourth aspect, the invention also relates to a paving machine for forming a concrete path, with as a characteristic that it is provided with a computer system with a monitor upon which one or more of the following data can be visualized:

- the width adjustment of the paving machine;
- when a concrete path is produced having a roof-shaped profile, in other words, with a surface sloping from the middle towards both lateral edges, data related to the shape of the pre-determined roof-shaped profile;
- the forward speed of the paving machine;
- the covered distance;
- the oscillation speed of applied vibration means for vibrating the concrete;
- the thickness of the concrete path, possibly calculated from other data, whether put-in or not;
- when the paving machine is provided with a dowel apparatus, the adjustment of the distance where dowels and/or joints are provided;
- the visualization of alarm functions;
- an indication as the dowel apparatus approaches the end of its travel course.

By means of this computer system, the operator, in a centralized manner, has different data available, as a result of which an efficient validation of the operation of the paving machine and/or of the obtained result is possible.

It is clear that at random a combination can be made of the first and/or the second and/or the third and/or the fourth aspects of the invention.

Further, the invention, as mentioned in the aforegoing, also relates to a method for forming a concrete path, with as a characteristic that for forming it, a paving machine is used showing one or more of the characteristics described heretofore, whereby during forming the concrete path, a regulation of the mutual position of said parts of at least one processing device is provided for, and/or a treatment of the concrete surface is performed by means of a finishing beam which simultaneously performs an oscillating movement in upward and sideward directions, and/or a registration, as aforementioned, takes place, and/or a visualization of data by means of a computer system takes place.

BRIEF DESCRIPTION OF THE DRAWINGS

With the intention of better showing the characteristics of the invention, hereafter, as an example without any limitative character, several preferred forms of embodiment are described, with reference to the accompanying drawings, wherein.

DESCRIPTION OF PREFERRED EMBODIMENTS

Figure 1:
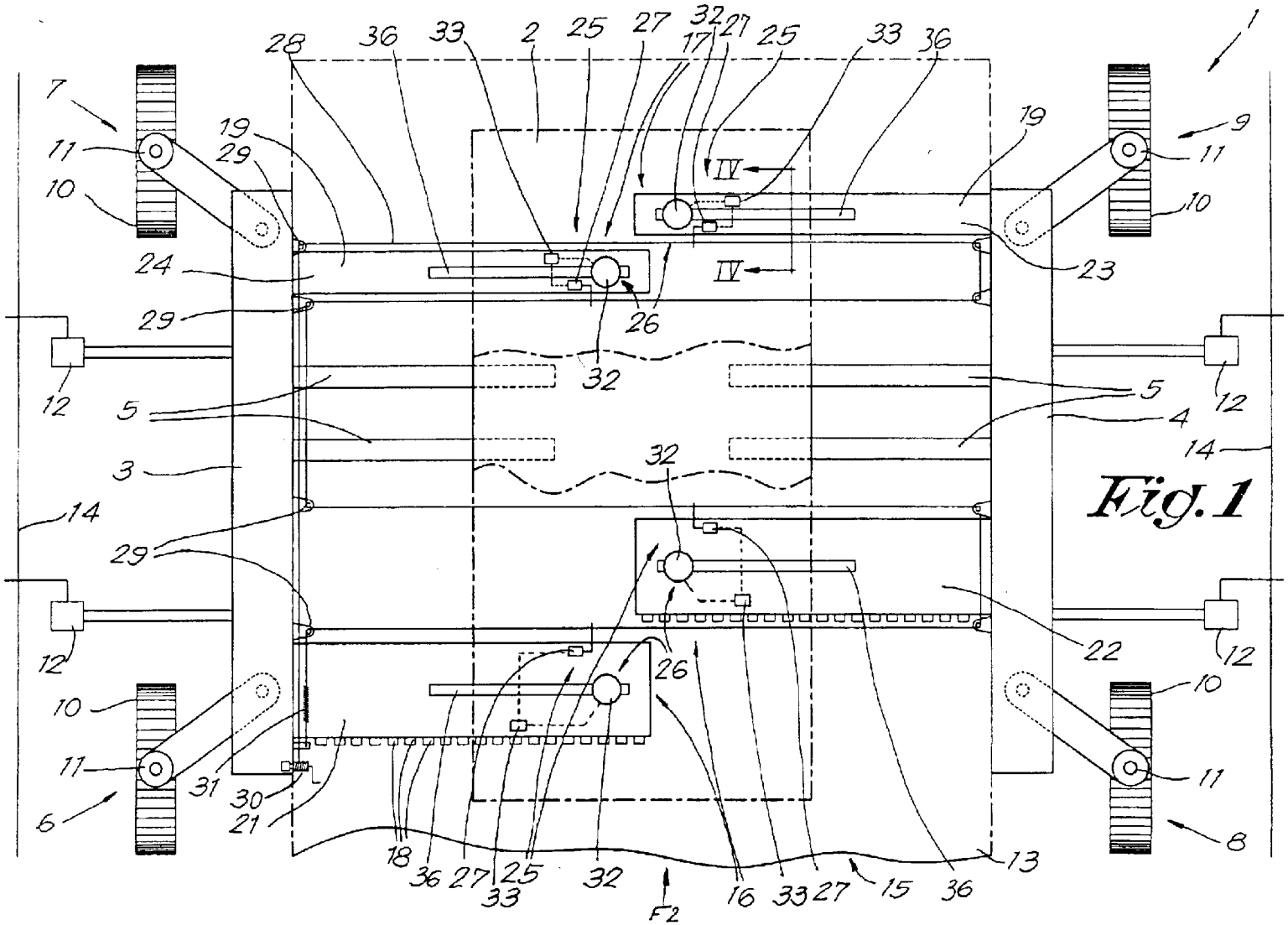
FIG. 1 in plan view schematically represents a paving machine according to the invention which applies the first aspect of the invention.
Figure 2:
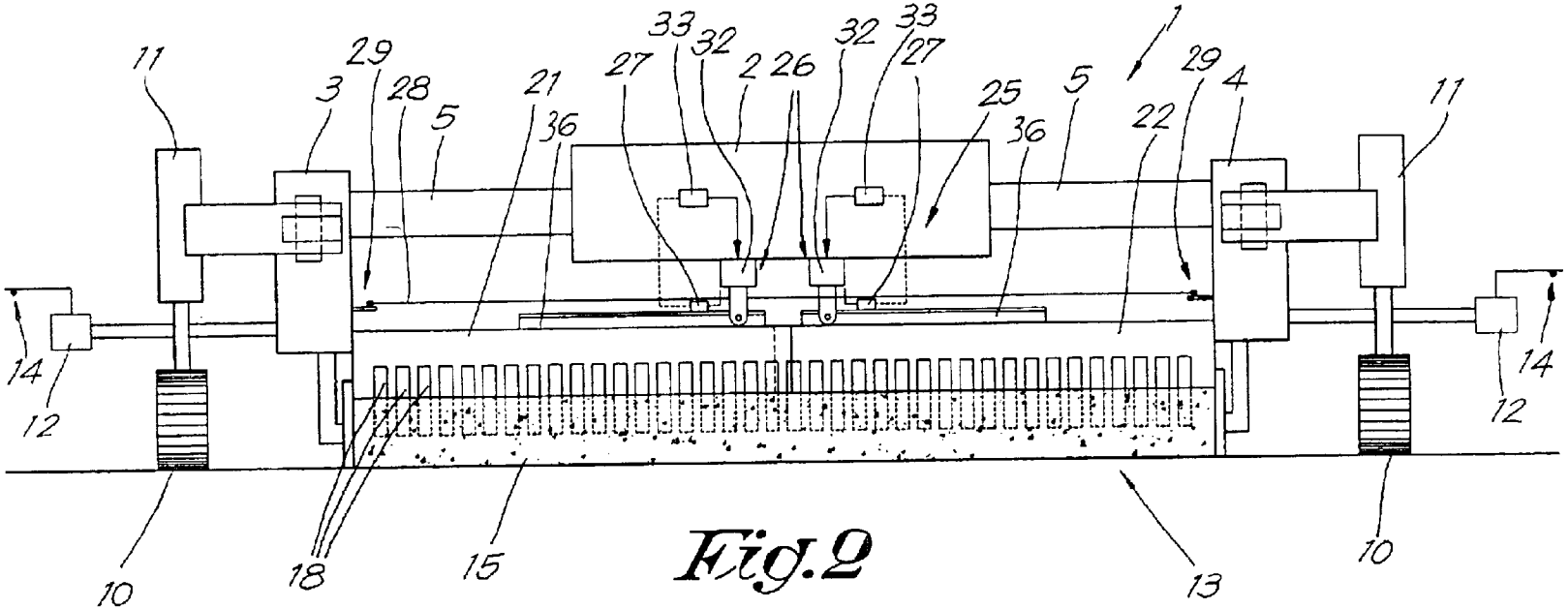
FIG. 2 represents a view according to arrow F2 in FIG. 1.

As represented in FIGS. 1 and 2, the invention relates to a paving machine 1. In the represented example, this machine substantially consists of a movable frame with, on one hand, a basic frame 2, on which a not-represented driver's cabin can be provided, and, on the other hand, side parts 3–4 which can be laterally displaced by means of frame parts 5 which are extensible in respect to the basic frame 2, whereby these side parts 3–4 are carried by support elements 6–7–8–9, which rest on the ground in a movable manner and which can be moved on, for example, by means of driven crawler wheels 10.

The support elements 6–7–8–9 comprise height adjustment means, such as vertical adjustment cylinders which allow to maintain the side parts 3–4 during moving at a permanent height, such by means of sensors 11 provided to monitor the concrete path 13 to be formed.

Figure 4:
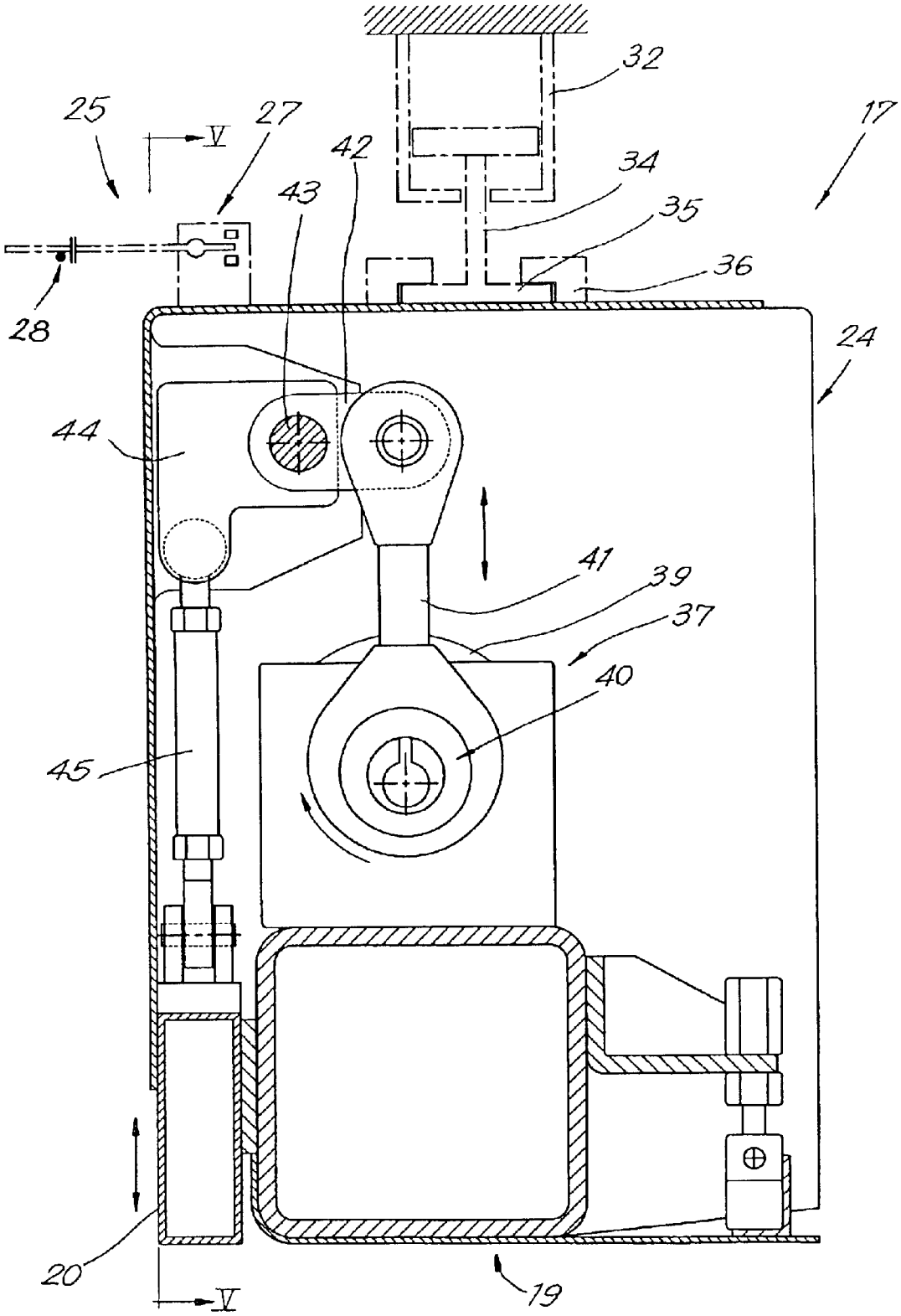
FIG. 4 represents a cross-section according to line IV—IV in FIG. 1, whereby an oscillating finishing beam is represented which is realized in accordance with the second aspect of the invention.

At the side parts 3–4 and below the basic frame 6, different processing devices 14 for the concrete 15 are attached, whereof, by way of example, only two are schematically represented, 16, 17, respectively. The processing device 16 functions as a form piece at which vibrating needles 18 or similar are attached. The processing device 17 substantially consists of a smoothing beam 19 and, for example, also comprises an oscillating finishing beam 20, as represented in FIG. 4.

The processing devices 16 and 17 each consist of two mutually opposed parts, or otherwise called screed elements, 21–22 and 23–24, respectively, which can be shifted along each other and can be adjusted in function of the working width. Next to the outwardly situated extremities, the parts 21 and 23 are fixedly or hingeably connected to the side part 3, whereas, at their inwardly directed extremities, they are suspended at the basic frame 2, as will be described in the following. In the proximity of the outwardly situated extremities, the parts 23 and 24 are fixedly or hingeably connected to the side part 4, whereas, with their inwardly directed extremities, they also are suspended at the basic frame 2.

In that the whole unit, on one hand, is extensible and therefore, there are plays present in the connections, and, on the other hand, such paving machine 1 mostly is applied for large working widths, it is obvious that the whole easily may sag or also may be pushed upward when centrally too large a mass of concrete is situated below the paving machine 1.

The invention offers a solution to this in that the paving machine 1 is provided with a control device or means which, on one hand, directly or indirectly controls the mutual position of the parts, on one hand, 21 and 22, and/or, on the other hand, 23 and 24, in respect to the concrete path's 13 surface to be formed, as well as, on the other hand, allow to adjust the mutual position in function of the thus obtained control.

The aforementioned means are formed by a detection device 25 performing observations in respect to said mutual position, as well as a controllable adjustment device 26 for commanding the parts 21–22 and/or 23–24 in such a manner that a desired adjustment is realized.

In the represented example, the detection device 25 includes sensors 27 provided at the parts 21–22–23–24, in the proximity of the inwardly directed extremities thereof, which sensors 27 cooperate with cable elements of cable system stretched between the side parts 3–4, which cable element in this case are formed of a single continuous cable 28, whereby the cable elements of the cable system function as reference lines. These sensors 27 are realized such that they deliver signals in function of the height position which the inwardly directed extremities of the parts 21–22–23–24 take in respect to the cable length extending alongside thereof.

These sensors 27 can be of different kind, however, preferably sensors of the same type as the sensors 12 will be applied. Hereby, they may be sensors which exclusively detect whether there is a deviation in one or the other direction, as well as sensors which do not only deliver signals in function of the direction of the deviation, but also in function of the amplitude thereof.

The cable 28 is stretched, by means of guiding rolls 29, to and fro between the side parts 3 and 4. the tensioning is performed by a tensioning device which, in this case, includes a winding system 30 for winding the cable 28 at one end, and of a tensioning spring 31 with which the other end is attached to a fixed point, in this case to the side part 3.

In the represented example, the controllable adjustment device 26 is situated between the basic frame 2 and the inwardly directed extremities of the parts 21–22–23–24 and includes pressure cylinders 32, in this case respectively a separate pressure cylinder 32 per part 21–22–23–24.

The controllable adjustment device 26 is coupled to the detection device 25, such that there is an automatic control. The coupling is performed by means of one or more appropriate control units 33. Such control unit may consist, in its most simple form, of a hydraulic valve which is controlled in three positions, to wit a closed position, a position whereby pressure is applied to the pertaining pressure cylinder, and a position whereby pressure is reduced.

The functioning of the paving machine 1, more particularly of said control, can easily be deduced from the aforegoing and from the drawings.

When manufacturing a flat concrete path 13, the detection device 25 is adjusted such, or such control by means of the control units 33 is provided for that the parts 21 and 22 remain parallel with their undersides, as well as the parts 23 and 24 remain parallel in respect to each other. With a deviation which indicates a sagging, the pressure cylinders are commanded such that the respective parts 21 and/or 22 and/or 23 and/of 24 are drawn upward at their inwardly directed extremity. With a pushing up, on the other hand, a downwardly directed pressure force will be realized, such that more weight of the paving machine 1 rests on the inwardly directed extremities.

Figure 3:
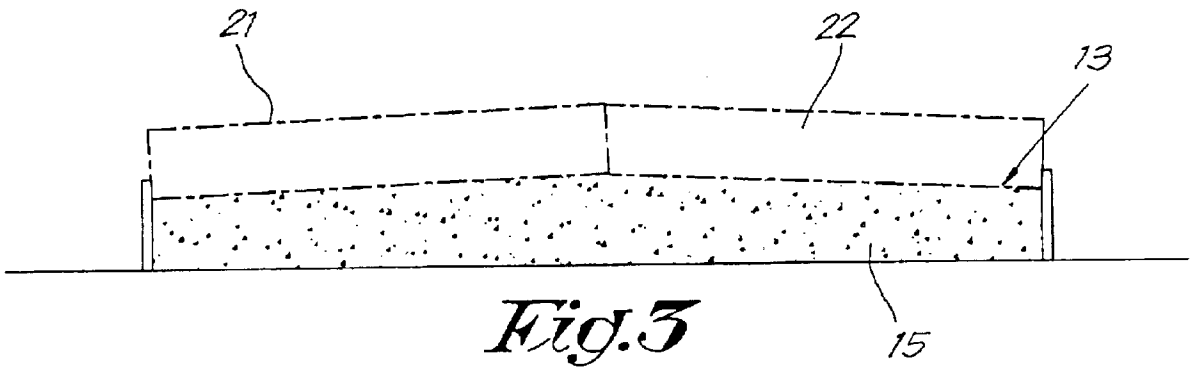
FIG. 3 schematically represents an embodiment of a concrete path.

It is obvious that by means of the invention, it is not only possible to achieve that the parts 21–22 and 23–24 mutually are situated in the same plane, but that also different adjustments can be realized, for example, for realizing, as schematically represented in FIG. 3, a concrete path 13 having a roof-shaped profile, with a well-defined slope. In this way, it is also possible to create a concrete path 13 which slopes exclusively in one direction.

Although the example solely represents an embodiment whereby only two parts 21–22, as well as 23–24, are present over the working width, it is obvious that it also can be applied with paving machines with several such parts adjacent to each other. Also, the invention can not only be applied with extensible paving machines, but also with a variety of other paving machines comprising parts which, under the influence of different factors, may take undesired deviating positions in respect to each other.

The controllable adjustment device 26 may be common for two parts pertaining to one another, for example, 21 and 22, or also 23 and 24, for example, when these are coupled to each other at their inwardly directed extremities.

Further, each control operation does not have to take place directly by means of a pertaining sensor 27. So, for example, may the sensor 27 of the part 21 provide for the control of the pertaining pressure cylinder, whereas the control of the pressure cylinder pertaining to part 22 also is performed by means of the sensor 27 placed upon part 21 or by a separate height adjustment, whereby the height of the free extremity of part 22 automatically is adjusted to the height of the free extremity of the part 21.

It is obvious that in the case of an extensible paving machine 1, of course steps must be taken in order to achieve that the inwardly directed extremities of the parts 21–22–23–24, for example, are movably coupled to the controllable adjustment device 26, for example, in a manner such as schematically indicated in FIG. 4, whereby the piston rod 34 of the respective pressure cylinder, by means of a slide 35, is seated, in a movable manner, in a guiding element 36 provided on the part situated therebelow.

Figure 5:
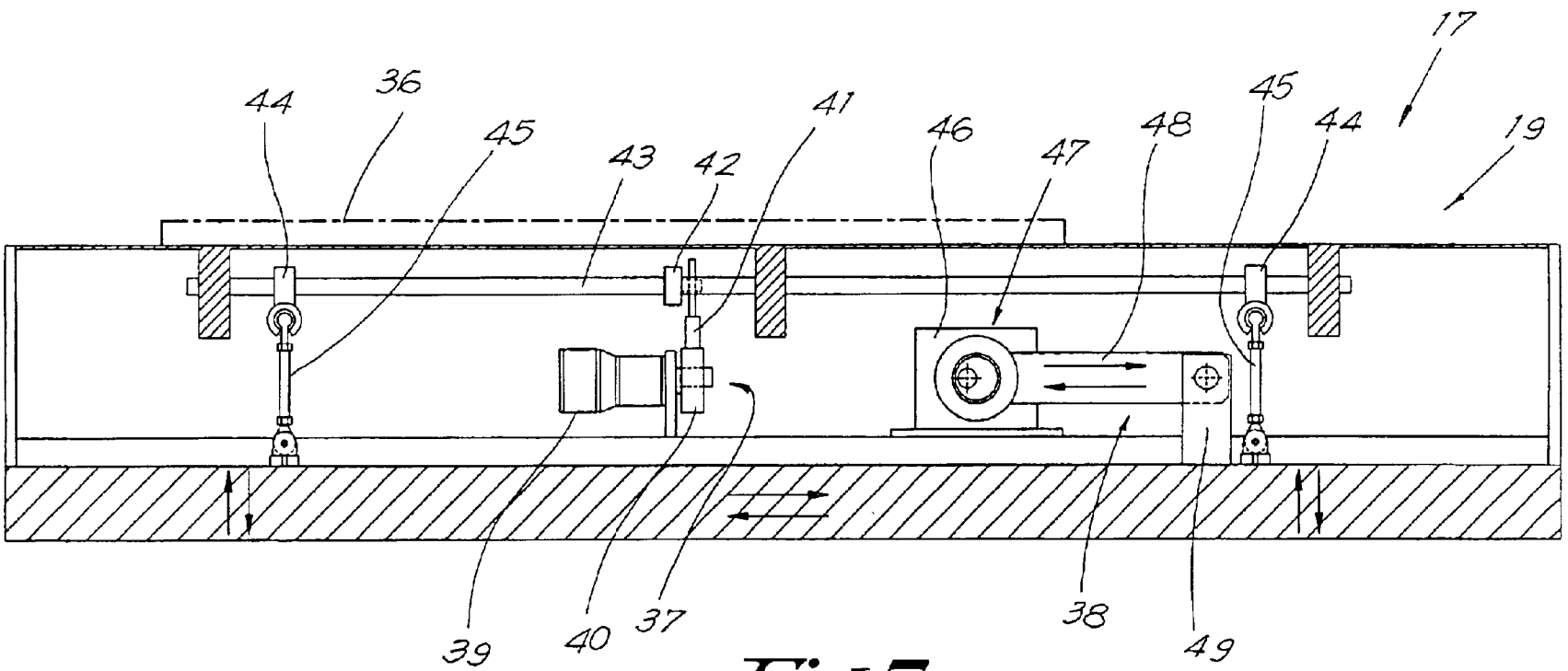
FIG. 5, at a smaller scale, represents a cross-section according to line V—V in FIG. 4.

In FIGS. 4 and 5, the second aspect of the invention is illustrated, to wit the fact that the paving machine 1 is provided with an oscillating finishing beam 20 which can perform an upward and a sideward oscillation at the same time. To this aim, it is driven by means of two excenter mechanisms 37 and 38 which respectively provide for the movements for the upward and sideward oscillations.

The excenter mechanism 37 is driven by a motor 39 and consists of an excenter 40 provided on the shaft of this motor 39, which excenter, by means of a rod 41, is hingeably connected to a lever 42 which is fixedly attached to a shaft 43, such that the shaft 43, during the rotation of the excenter 40, is turned to and fro in an oscillating manner. To this shaft 43, two arms 44 are fixedly attached, at which the finishing beam 20 is suspended by means of coupling parts 45.

The excenter mechanism 38 is driven by a motor 46 and consists of an excenter 47 provided on the shaft of this motor 46, which excenter, by means of a rod 48; is hingeably connected to the finishing beam 20, by means of a coupling flange 49 provided thereupon in a fixed manner.

The shaft 43 is fixedly positioned in support points 44.

The functioning of the finishing beam 20, more particularly the oscillating drive thereof, can easily be derived from FIGS. 4 and 5. By means of the motor 39 and by the excenter 40, the shaft 43 is driven in a to-and-fro oscillating manner. This results in an up-and-down-going movement of the coupling parts 45 and, thus, of the finishing beam 20. At the same time, this finishing beam 20 is moved to and fro by means of the motor 46, the excenter 47 and the crankshaft 48, such that a combined movement is created.

It is obvious that different oscillation speeds can be applied, whereby these possibly may be adjustable. Also, different oscillation speeds and/or oscillation amplitudes for the sideward and upward movements can be applied, depending on the desired effect.

FIGS. 1 and 4 also show that the finishing beam 20 may consist of two parts, which are provided at the parts 23 and 24, respectively.

It is obvious that, in order to realize the third aspect described in the introduction, the necessary sensors and such will be provided at the different parts of the paving machine 1 in order to enable that the parameters to be registered or data which are necessary for determining the parameters to be registered, can be observed. Also, such parameters can be deduced from control operations. So, for example, frequency-controlled motors can be used for the vibration needles 18 which mostly have excenters driven by means of motors, such that the oscillation frequency of the vibration needles 18 immediately can be derived from the control values of the frequency control.

In a similar manner, values can be collected and observed in order to feed the computer system mentioned in the introduction.

The present invention is in no way limited to the forms of embodiment described by way of example and represented in the figures, on the contrary may such paving machine, as well as the aforementioned method, be realized according to various variants while still remaining within the scope of the invention.

What is claimed is:

1. A paving machine arranged to spread and level concrete along a path, the paving machine comprising:

a frame assembly;

at least one concrete processing device carried by the frame assembly, said processing device including at least two mutually opposed screed elements spanning the width of the frame assembly and arranged to be mutually adjusted in height relative to the frame assembly; and a control device configured to position the at least two screed elements relative to the frame assembly, said control device having a detection device configured to observe the Dosition of the screed elements relative to one another, and at least one position device configured to adjust the position of the screed elements relative to one another.

2. The paving machine according to claim 1, wherein the adjustment device is connected to the detection device such that the adjustment device automatically regulates the position of the screed elements relative to one another.

3. The paving machine according to claim 1, wherein the control device controls the position of the at least one processing device relative to the path formed by the paving machine.

4. The paving machine according to claim 1, wherein the frame assembly comprises:

support elements supporting the paving machine; and two side parts carried by a respective one of said support elements, said side parts defining a reference line or plane for the control device.

5. The paving machine according to claim 4, wherein the screed elements are connected at an outer end thereof to a respective one of the side parts, an inner end opposed to said outer end of the screed elements being adjustable in height relative to the outer end thereof.

6. The paving machine according to claim 5, further comprising:

a central frame portion connecting to each of said side parts and including a plurality of extensible members arranged along the width of the frame assembly, said extensible members permitting the adjustment of the width of the paving machine;

wherein the adjustment device is positioned between the central frame and each of the screed elements.

7. The paving machine according to claim 4, wherein the detection device comprises a cable system comprising at least one cable element extending over the width of the frame assembly and at least one sensor cooperating with the at least one cable element, the at least one sensor monitoring the relative placement of the screed elements relative to the at least one cable.

8. The paving machine according to claim 1, further comprising at least two processing devices and a control device for each respective one of the processing devices.

9. The paving machine according to claim 7, wherein several cable elements of said cable system are stretched over the width of the frame assembly between the side parts thereof at substantially the height of the screed elements, said at least one sensor cooperating with the cable system to determine the position of the screed elements relative to the cable system.

10. The paving machine according to claim 9, wherein said cable system comprises a single, continuous cable element.

11. The paving machine according to claim 7, further comprising a tensioning device configured to tension the at least one cable element of the cable system, said tensioning device including a winding device arranged to wind the at least one cable element and connected at one end thereof, and an elastic tensioning device connected to the at least one cable element at another end thereof, and connected to one of said side parts.

12. The paving machine according to claim 1, wherein the at least one processing device includes a smoothing beam.

13. The paving machine according to claim 1, wherein said at least one adjustment device including at least one pressure cylinder positioned between the screed elements and the frame assembly.

14. A paving machine arranged to spread and level concrete along a path, the paving machine comprising:

a frame assembly;

at least one concrete processing device carried by the frame assembly, said processing device including at least two mutually opposed screed elements spanning the width of the frame assembly and arranged to be mutually adjusted in height relative to the frame assembly; and a control device configured to position the at least two screed elements relative to the frame assembly, said control device including at least one adjustment device configured to adjust the position of the at least two screed elements relative to one another.

* * * * *

UNITED STATES PATENT AND TRADEMARK OFFICE

CERTIFICATE OF CORRECTION

PATENT NO. : 6,773,203 B2
DATED : August 10, 2004
INVENTOR(S) : Francois Casters It is certified that error appears in the above-identified patent and that said Letters Patent is hereby corrected as shown below:

Column 10,
Line 28, delete “Dosition” and insert -- position --.
Line 29, delete “position” and insert -- adjustment --.

Signed and Sealed this

Twenty-fourth Day of May, 2005

JON W. DUDAS
*Director of the United States Patent and Trademark Office*

US006773203C1

(12) EX PARTE REEXAMINATION CERTIFICATE (6300th)

United States Patent

Casters

(10) Number: US 6,773,203 C1

(45) Certificate Issued: Jul. 15, 2008

(54) PAVING MACHINE AND METHOD FOR FORMING A CONCRETE BATH

(75) Inventor: François Casters, Opglabbeek (BE)

(73) Assignee: Drion Constructie, besloten vennootschap met beperkte aansprakelijkheid, Opglabbeek (BE)

Reexamination Request:
No. 90/008,300, Dec. 20, 2006

Reexamination Certificate for:

| | |
|---|---|
| Patent No.: | **6,773,203** |
| Issued: | **Aug. 10, 2004** |
| Appl. No.: | **10/161,741** |
| Filed: | **Jun. 5, 2002** |

Certificate of Correction issued May 24, 2005.

(30) Foreign Application Priority Data

Jun. 5, 2001 (BE) ..... 20010380

(51) Int. Cl.
*E01C 19/22* (2006.01)

(52) U.S. Cl. ..... 404/84.1; 404/101; 404/118

(58) Field of Classification Search ..... 404/84.1, 404/101, 118

See application file for complete search history.

(56) References Cited

U.S. PATENT DOCUMENTS

| | | | |
|---|---|---|---|
| 3,416,416 | A | 12/1968 | Long et al. |
| 3,533,337 | A | 10/1970 | Swisher et al. |
| 3,540,360 | A | 11/1970 | Snow et al. |
| 3,636,832 | A | 1/1972 | Schrimper et al. |
| 3,816,014 | A | 6/1974 | Klopf |
| 3,817,644 | A | 6/1974 | Matson |
| 3,873,226 | A | 3/1975 | Teach |
| 4,360,293 | A | 11/1982 | Wade |
| 4,379,653 | A | 4/1983 | Brown |
| 4,722,636 | A | 2/1988 | Brock |
| 5,101,360 | A | 3/1992 | Bennett |
| 5,215,404 | A | 6/1993 | Raymond |
| 5,507,591 | A | 4/1996 | Lyons et al. |
| 5,752,783 | A | 5/1998 | Malone |
| 6,022,170 | A | 2/2000 | Rower |
| 6,055,486 | A | 4/2000 | Minnich et al. |
| 6,471,442 | B1 | 10/2002 | Deeb et al. |

FOREIGN PATENT DOCUMENTS

| | | |
|---|---|---|
| DE | 87 00 378.3 | 4/1987 |
| EP | 0 493 664 | 7/1994 |
| GB | 2 192 418 | 1/1988 |
| JP | 405287705 | 11/1993 |

*Primary Examiner*—Jimmy G. Foster

(57) ABSTRACT

A paving machine arranged to spread and level concrete along a path. The paving machine has a frame assembly, and at least one concrete processing device carried by the frame assembly. The processing device include at least two mutually screed elements spanning the width of the frame assembly and are mutually adjustable in height relative to the frame assembly. The paving machine further include a control device that positions the at least two screed elements relative to the frame assembly.

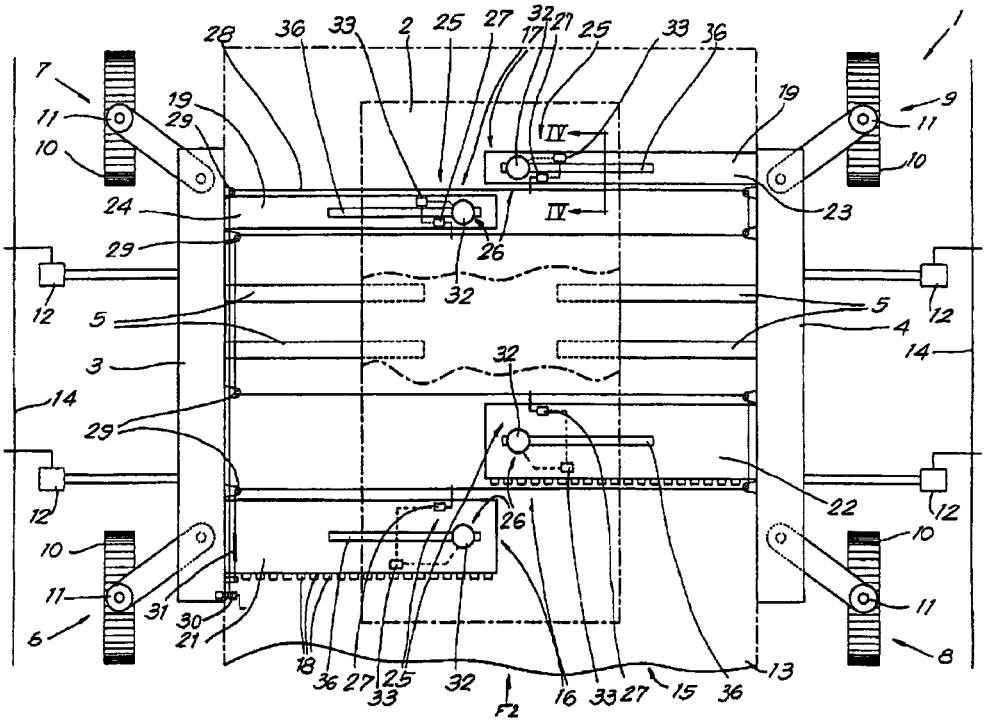

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 14 are determined to be patentable as amended.

Claims 2–13, dependent on an amended claim, are determined to be patentable.

1. A paving machine arranged to spread and level concrete along a path, the paving machine comprising:

a frame assembly;

at least one concrete processing device carried by the frame assembly, said processing device including at least two mutually opposed screed elements *arranged in tandem and combining to define a variable width screed profile* spanning the width of the frame assembly and arranged [to be mutually adjusted] *such that inner extremities of the screed elements are individually adjustable* in height relative to the frame assembly; and a control device configured to position the at least two screed elements relative to the frame assembly, said control device having a detection device configured to observe the position of the screed elements relative to one another, and at least one adjustment device configured to *individually* adjust the [position] *height of the inner extremities* of the screed elements relative to one another.

14. A paving machine arranged to spread and level concrete along a path, the paving machine comprising:

a frame assembly;

at least one concrete processing device carried by the frame assembly, said processing device including at least two mutually opposed screed elements *arranged in tandem and combining to define a variable width screed profile* spanning the width of the frame assembly and arranged [to be mutually adjusted] *such that inner extremities of the screed elements are individually adjustable* in height relative to the frame assembly; and a control device configured to position the at least two screed elements relative to the frame assembly, said control device including at least one adjustment device configured to *individually* adjust the [position] *height of the inner extremities* of the at least two screed elements relative to one another.

* * * * *